US005934367A

United States Patent [19]

Shimmura et al.

[11] Patent Number: 5,934,367

[45] Date of Patent: Aug. 10, 1999

[54] HEAT EXCHANGER

[75] Inventors: Toshiharu Shimmura; Tomohiro Chiba; Kazuki Hosoya, all of Isesaki, Japan

[73] Assignee: Sanden Corporation, Gunma, Japan

[21] Appl. No.: 08/975,362

[22] Filed: Nov. 20, 1997

[30] Foreign Application Priority Data

Dec. 19, 1996 [JP] Japan ..... 8-355211

[51] Int. Cl.[6] ..... F28F 9/22; F28D 1/03

[52] U.S. Cl. ..... 165/174; 165/153; 165/176

[58] Field of Search ..... 165/153, 174, 165/176; 62/515

[56] References Cited

U.S. PATENT DOCUMENTS

| | | | |
|---|---|---|---|
| 4,458,750 | 7/1984 | Huber . | |
| 5,241,839 | 9/1993 | Hughes | 62/515 |
| 5,415,223 | 5/1995 | Reavis et al. | 165/174 X |

FOREIGN PATENT DOCUMENTS

| | | | |
|---|---|---|---|
| 0228330 | 7/1987 | European Pat. Off. . | |
| 0632245 | 1/1995 | European Pat. Off. . | |
| 2721698 | 12/1995 | France . | |
| 1044125 | 11/1958 | Germany | 165/174 |
| 154995 | 6/1990 | Japan | 165/174 |
| 260566 | 11/1991 | Japan . | |
| 260567 | 11/1991 | Japan . | |
| 353397 | 12/1992 | Japan | 165/176 |
| 346297 | 12/1993 | Japan | 165/176 |
| 890896 | 3/1962 | United Kingdom | 165/174 |

*Primary Examiner*—Leonard R. Leo
*Attorney, Agent, or Firm*—Baker & Botts, L.L.P.

[57] ABSTRACT

A two path flow, laminated-type heat exchanger for an automotive refrigerant circuit includes a plurality of heat transfer tubes, a plurality of fins, and a tank. The tank is divided into three chambers. The second and third chambers are in fluid communication with the heat transfer tubes, each of which tubes has an interior U-shaped flow path. A plurality of holes of different radii or one diamond-shaped hole or a wall dividing the first chamber into two sub-chambers may be provided between the first chamber and the second chamber. The fluid enters through an inlet orifice and flows into the first chamber. Imbalances in the fluid's mass-flow rate along the length of the tank are leveled as the fluid passes from the first chamber to the second chamber. The fluid now possessing a leveled mass-flow rate enters the heat transfer tubes. Thus, the fluid in every heat transfer tube is leveled. The fluid flowing within each of heat transfer tubes then is collected in the third chamber, and exits through the outlet orifice. Therefore, the surface temperature of the heat exchanger is balanced during operation.

12 Claims, 11 Drawing Sheets

HEAT EXCHANGER

BACKGROUND OF THE INVENTION

1. Field of the Invention

The present invention relates to heat exchangers for use in automotive air conditioning refrigerant circuits, and more particularly, to heat exchangers having a reduced thickness, over which the surface temperature is more evenly distributed, during operation.

2. Description of the Related Art

In FIG. 1, a known laminated-type heat exchanger, referred to as a "drain cup," is depicted. A heat exchanger 120 is constructed from a tank 101, a plurality of heat transfer tubes 102, a plurality of fins 103, and sideplates 106 and 107. All of these components are fixed together by brazing. Heat transfer tubes 102 and fins 103 are layered alternatively, with the outermost of fins 103 being provided with sideplates 106 and 107, respectively. Each of heat transfer tubes 102 defines a U-shaped flow path for fluid. The two ends of the U-shaped path are connected to tanks 101*a* and 101*b*, respectively. Tank 101*a* is divided further into two sub-tanks 101*c* and 101*d* by a partition (not shown). An inlet pipe 104 is connected to tank 101*c*, and an outlet pipe 105 is connected to tank 101*d*.

In FIG. 2, a schematic diagram illustrates the flow path of a fluid, for example, a refrigerant, within heat exchanger 120 according to the prior art. This mode of flow is referred to as a 4-path flow. Each of heat transfer tubes 102 is constructed from two plates 9, as shown in FIG. 3. In plate 9, an interior U-shaped flow path is formed by a shallow recess 10. A plurality of projections 13 are provided to create turbulence in the fluid flowing within heat transfer tubes 102. When assembling heat exchanger 120, protrusions 11 and 12 are connected to tank 101. The two plates 9 are connected face to face to form one heat transfer tube 102.

In the field of automotive air conditioning systems, it is desirable to reduce the size and the thickness of heat exchangers. However, reducing the size of the heat exchanger, while retaining the structure of conventional laminated-type heat exchangers, results in the problem of increased pressure loss. Generally, pressure loss in a heat exchanger is proportional to the length of the flow path, and inversely proportional to the cross-sectional area of the flow path. In order to reduce the thickness of heat exchanger 120, it is necessary to decrease the width of heat transfers tubes 102. Decreasing the width of heat transfer tubes 102 requires decreasing the width d of flow path 10, indicated in FIG. 3. Because the cross-sectional area of flow path 10 is proportional to its width d, decreasing d directly results in an increase in the pressure loss of the heat exchanger.

One attempt to solve this problem is depicted in FIG. 4. A heat exchanger 130 is constructed from a plurality of heat transfer tubes 102, a plurality of fins 103, sideplates 106 and 107, and a tank 111. Heat transfer tubes 102 are in fluid communication with tanks 111*a* and 111*b*. An inlet pipe 112 is connected to tank 111*a*, and an outlet pipe 113 is connected to tank 111*b*. In FIG. 5, a schematic diagram illustrates the flow path of refrigerant within the heat exchanger 130. This mode of flow of refrigerant is referred to as a 2-path flow.

Compared to 4-path flow heat exchanger 120, 2-path heat flow exchanger 130 has improved pressure loss characteristics and reduced size. In determining that 2-path flow heat exchanger 130 is superior to 4-path flow heat exchanger 120, it is assumed that 4-path flow heat exchanger 120, as depicted in FIG. 1, and 2-path flow heat exchanger 130, as depicted in FIG. 4, have the same number and same size of heat transfer tubes 102. With reference to FIGS. 2 and 5, the length of the flow path from inlet pipe to outlet pipe of 4-path flow heat exchanger 120 is twice that of 2-path flow heat exchanger 130. Accordingly, the pressure loss experienced by 2-path flow heat exchanger 130 is one-half that of 4-path flow heat exchanger 120. Further, the number of heat transfer tubes 102 that are directly in communication with the inlet pipe in 2-path flow heat exchanger 130 is twice that of 4-path flow heat exchanger 120. The total cross-section of the flow path of 2-path flow heat exchanger 130 is twice that of 4-path flow heat exchanger 120. Consequently, the pressure loss experienced by 2-path flow heat exchanger 130 is further reduced. As a result, 2-path flow heat exchanger 130 has an advantage of one-fourth of the pressure loss experienced by 4-path flow heat exchanger 120. In other words, ignoring the entire surface area for heat exchange, it is possible to reduce the size of 2-path flow heat exchanger 130 to one-fourth that of 4-path flow heat exchanger 120, while achieving the same pressure loss.

Still, the 2-path flow heat exchanger 130, as depicted in FIG. 4, has other disadvantages. For example, uneven temperature distribution occurs on the surface of 2-path flow heat exchanger 130 when the refrigerant circuit is operated. With reference to FIG. 5, the farther the heat transfer tubes 102 are from inlet pipe 112, the more active heat transfer occurs, or inversely, the nearer the heat transfer tubes 102 are to inlet pipe 112, the less active heat transfer occurs. When heat exchanger 130 is an evaporator, heat transfer tubes 102 that are farthest from inlet pipe 112 attain the lowest temperatures, and inversely, the temperature of heat transfer tubes 102 that are nearest to inlet pipe 112 is less reduced. The temperature difference between these heat transfer tubes may be several degrees.

In FIG. 5, a schematic diagram illustrates the flow of a fluid, for example, a refrigerant, flowing within 2-path flow heat exchanger 130. The refrigerant enters through inlet pipe 112 and travels to tank 111*a*. Within tank 111*a*, the refrigerant is distributed to each of heat transfer tubes 102. Also, within tank 111*a*, the refrigerant component that is more liquid reaches the deepest portion of tank 111*a*, because it is heavier. The component that is more gaseous, however, does not reach that portion of tank 111*a*, because it is lighter. This occurs because the refrigerant component with more liquid has a larger mass, and the refrigerant component that is more gaseous has a smaller mass. The flow velocities of refrigerant in each of heat transfer tubes 102 are about equal. As a result, a gradient in mass-flow rate from heat transfer tubes 102, on the right-hand side of FIG. 5, to those tubes 102, on the left-hand side of FIG. 5, is created. In other words, an imbalance in the mass-flow rate in the heat transfer tubes, corresponding to the distance from the inlet pipe, occurs. In the left-most heat transfer tubes, the mass-flow rate is highest and the most active heat transfer occurs, causing the surface temperature of the heat exchange to be significantly reduced. In the right-most heat transfer tubes, however, the mass-flow rate is lowest and the least active heat transfer occurs, causing the surface temperature to be less significantly reduced. This phenomenon is well known in the field of heat exchangers.

In accordance with the foregoing description, to reduce the thickness of the laminated-type heat exchanger, it is possible to change the flow mode from a 4-path flow to a 2-path flow. However, as noted above, 2-path flow heat exchangers experience spacial imbalance of heat transfer that decreases the overall heat transfer performance of the heat exchanger.

SUMMARY OF THE INVENTION

Thus, a need has arisen to suppress the spacial temperature imbalance on the surface of the 2-path flow mode laminated-type heat exchanger. These and other problems with known heat exchangers art are addressed by the following invention.

Accordingly, it is an object of the present invention to provide a 2-path flow laminated-type heat exchanger of which spacial temperature imbalance is reduced or eliminated. For this purpose, each of a plurality of heat transfer tubes forms a U-shaped flow path and the heat exchanger includes a plurality of fins attached to exterior surfaces of each of the heat transfer tubes. Mass-flow rate leveling means which make the mass-flow rates flowing in each heat transfer tubes more uniform, is provided within the tank of the heat exchanger. The mass-flow rate leveling means controls the mass-flow rate in the heat transfer tubes according to the distance of the tubes from the inlet pipe. In particular, the farther the tubes are from the inlet pipe, the more the mass-flow rate is reduced.

In an embodiment of the present invention, the mass-flow rate leveling means comprises a plate that divides the tank into three chambers and that has a series of holes formed therein of various radii. In another embodiment of the present invention, the mass-flow rate leveling means comprises a plate that again divides the tank into three chambers and that has one diamond-shaped hole formed therein. In still another embodiment of the present invention, the mass-flow rate leveling means comprises a wall provided in the tank, which diverts the flow of refrigerant from the inlet pipe into several flows and creates turbulence in the flowing fluid to reduce the imbalance in the mass-flow rates distributed to each heat transfer tube. In yet another embodiment of the present invention, draining holes penetrate vertically through the walls described above.

Further objects, features, and advantages of this invention will be understood from the following detailed description of the preferred embodiments of this invention with reference to the annexed drawings.

DETAILED DESCRIPTION OF PREFERRED EMBODIMENTS

Figure 1:
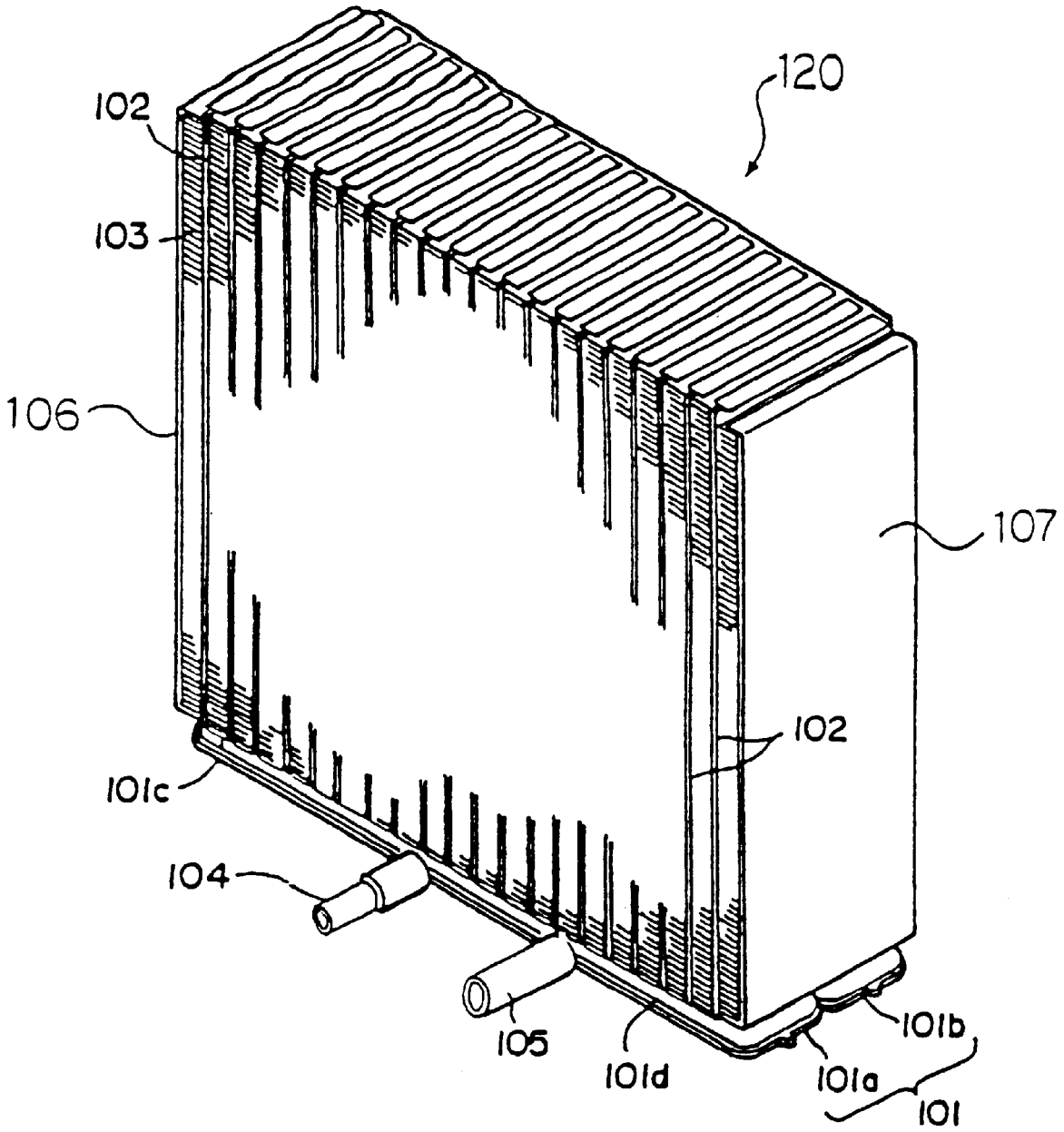
Fig. 1 (Prior Art)
FIG. 1 is a perspective view of a 4-path flow, laminated-type heat exchanger according to the prior art.
Figure 2:
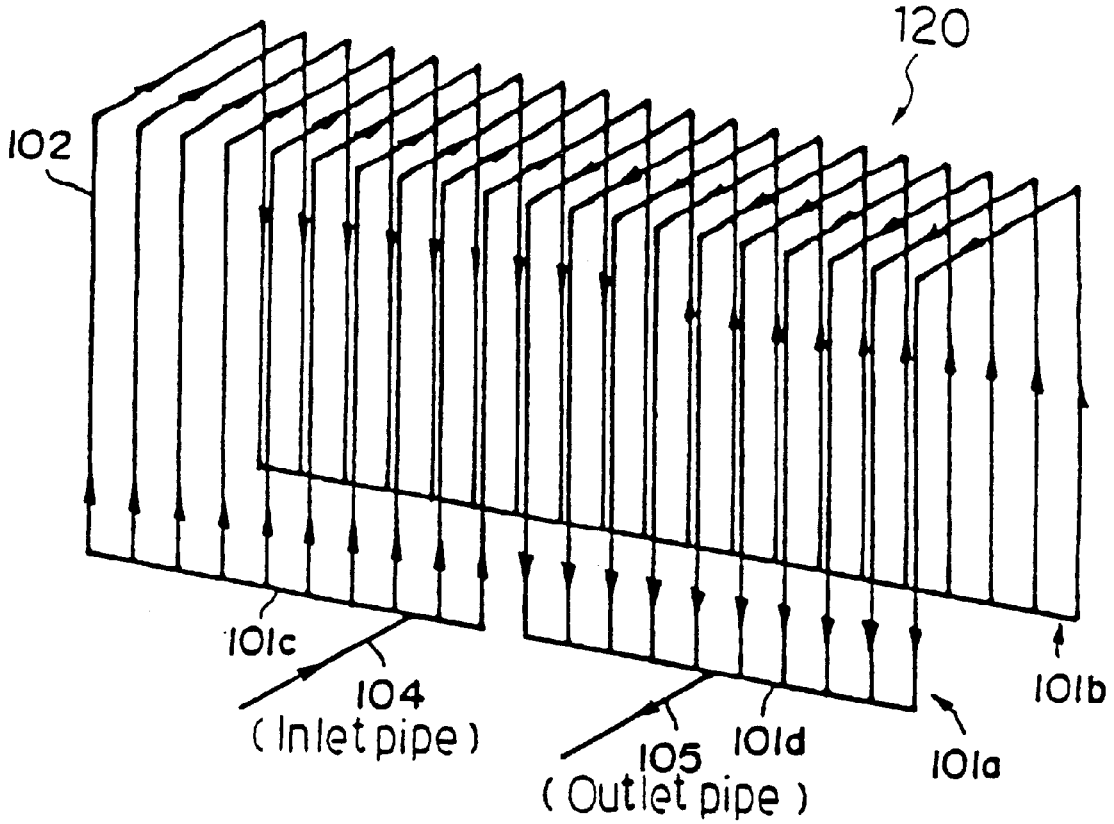
Fig. 2 (Prior Art)
FIG. 2 is a diagram of a fluid flow in the heat exchanger of FIG. 1.
Figure 3:
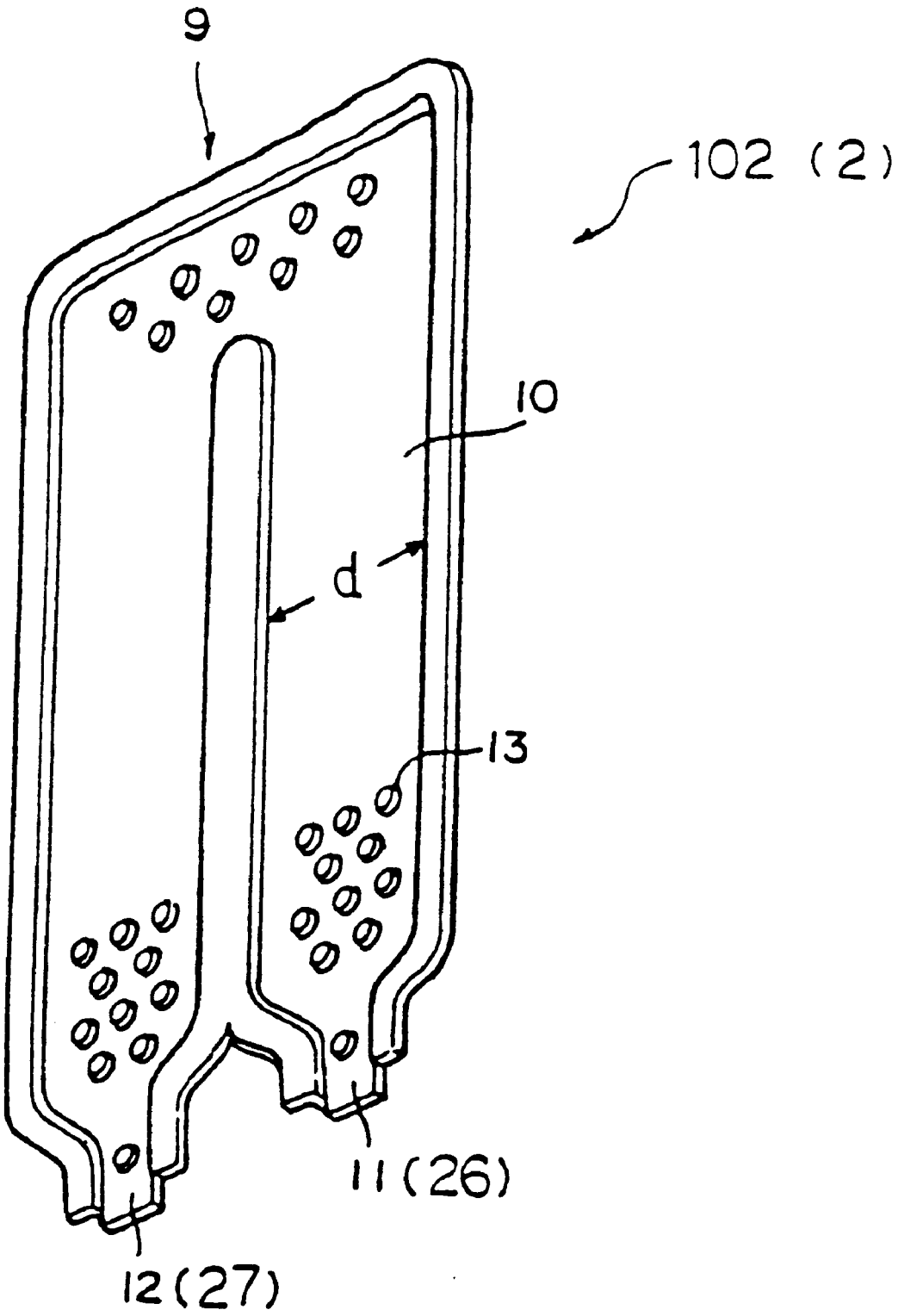
Fig. 3 (Prior Art)
FIG. 3 is a perspective view of one of a pair of plates which used to fabricate a heat transfer tube.
Figure 4:
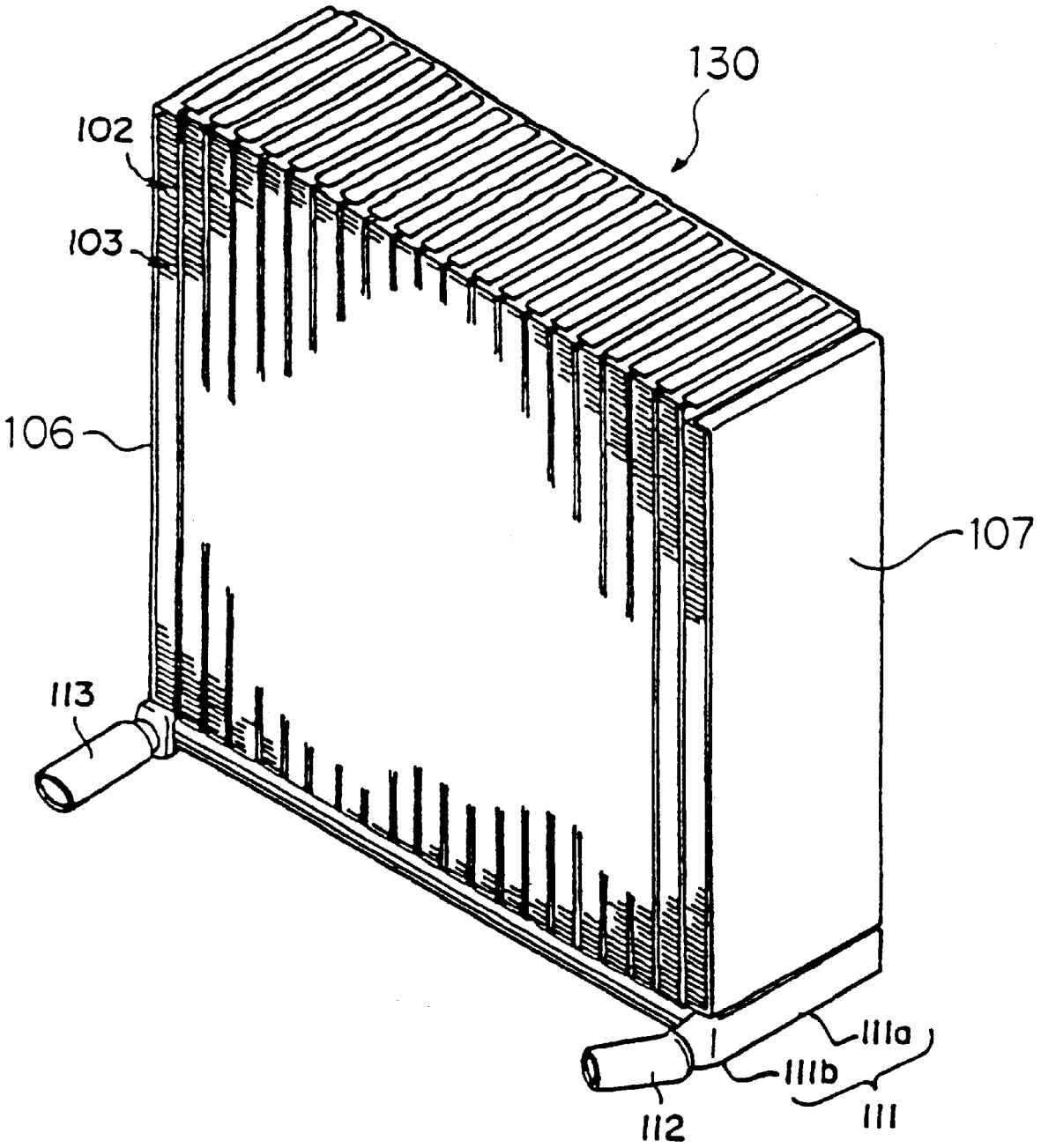
Fig. 4 (Prior Art)
FIG. 4 is a perspective view of a 2-path flow, laminated-type heat exchanger according to the prior art.
Figure 5:
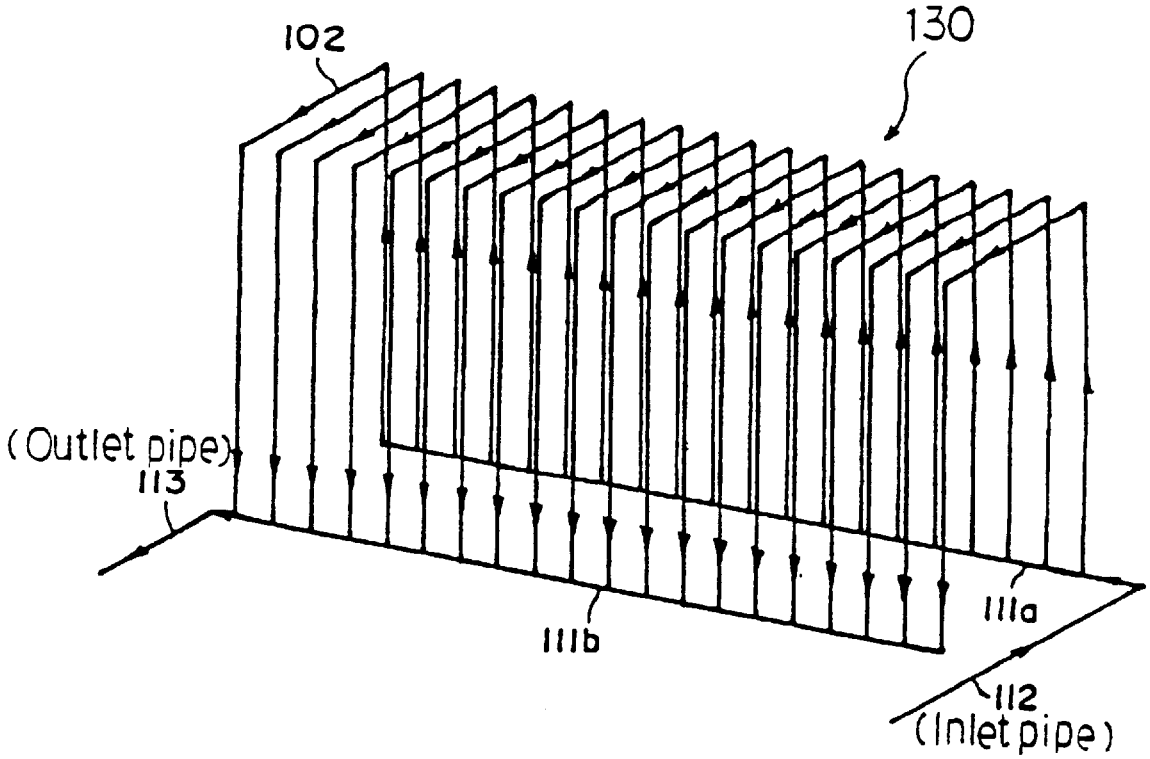
Fig. 5 (Prior Art)
FIG. 5 is a diagram of a fluid flow in the heat exchanger of FIG. 4.
Figure 6:
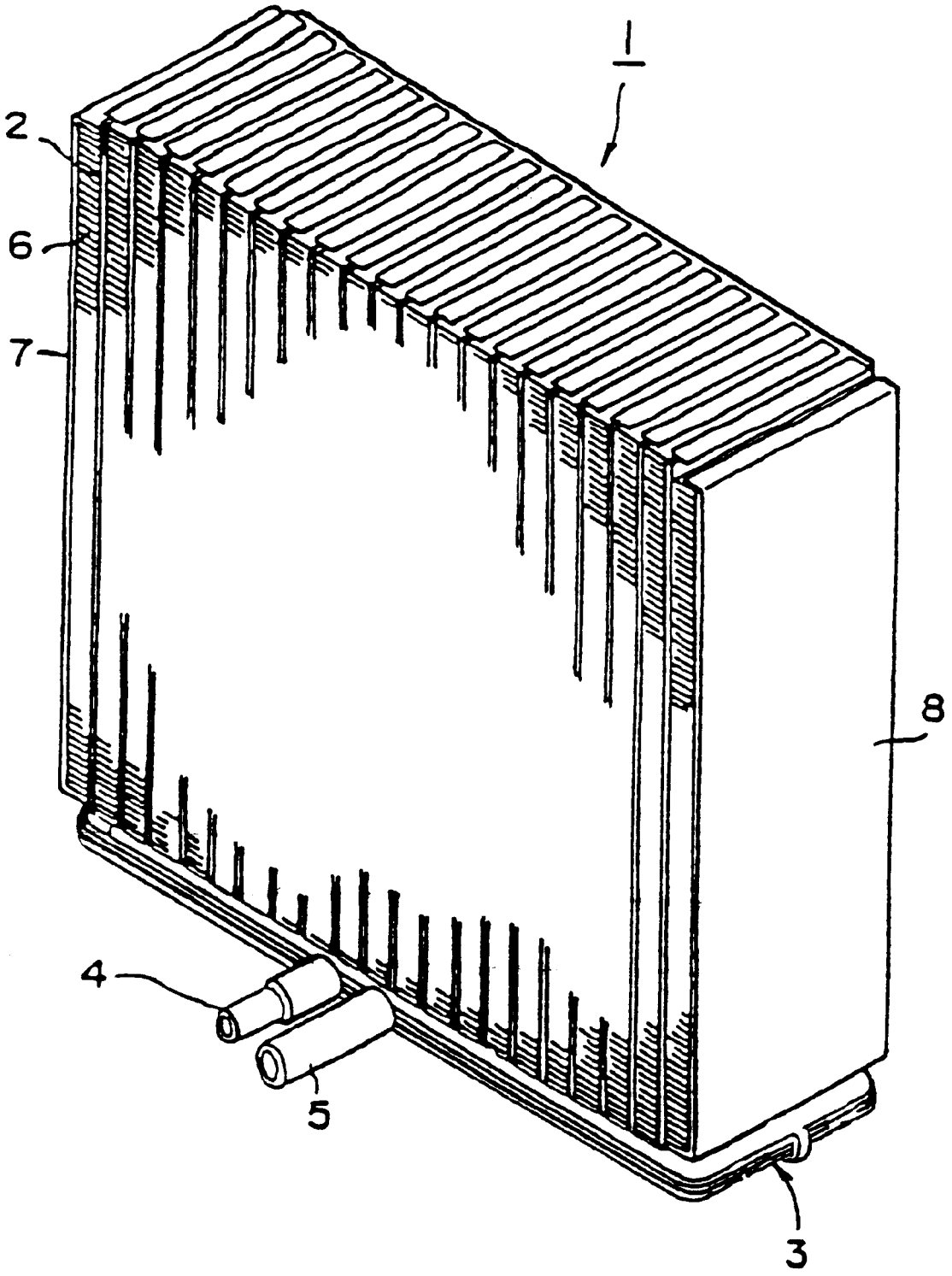
FIG. 6 is a perspective view of a 2-path flow, laminated-type heat exchanger according to a first embodiment of the present invention.

With reference to FIGS. 6–10, a first embodiment of the present invention is described below. In FIG. 6, a 2-path flow, laminated-type heat exchanger is depicted according to a first embodiment of the present invention. A heat exchanger 1 is constructed from a tank 3, a plurality of heat transfer tubes 2, a plurality of fins 6, and sideplates 7 and 8. All of these components may be fixed together by brazing. Heat transfer tubes 2 and fins 6 are layered alternatively. The outermost of fins 6 are provided with sideplates 7 and 8, respectively. Heat transfer tubes 2 are substantially identical to heat transfer tubes 102 used in known heat exchangers 120 and 130 and are constructed from two plates 9, as shown in FIG. 3. An inlet pipe 4 and an outlet pipe 5 are connected to tank 3.

Figure 7:
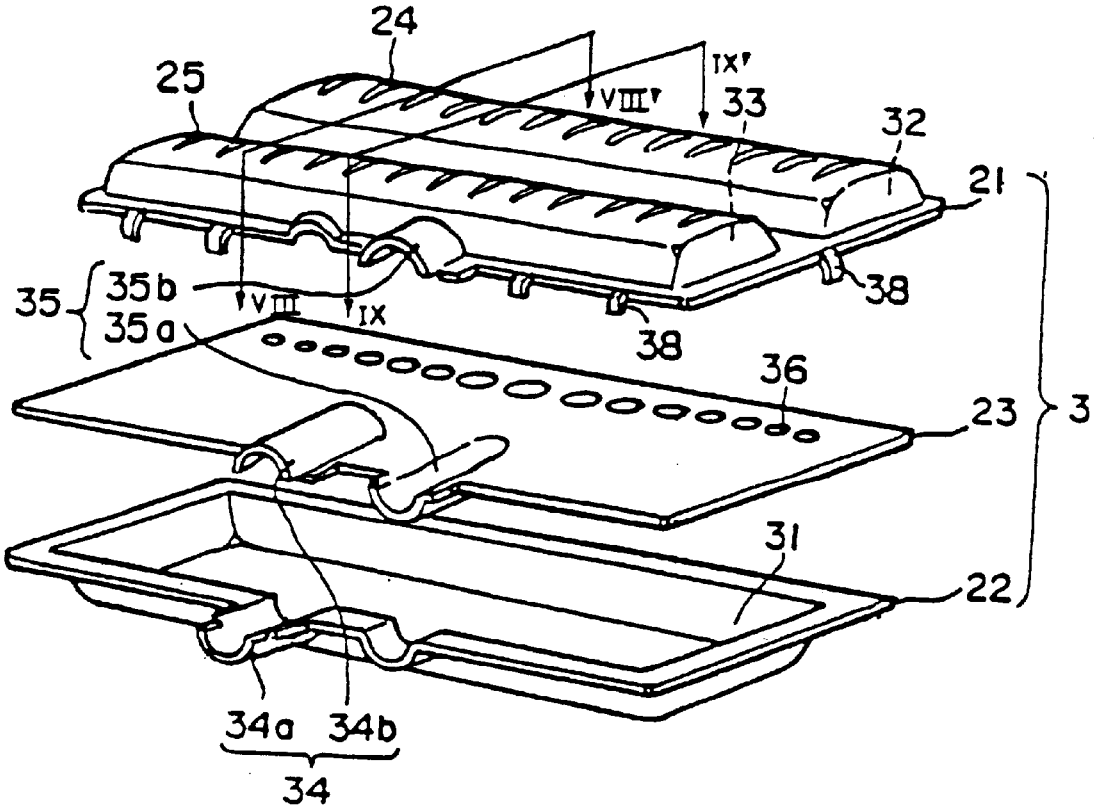
FIG. 7 is an expanded, perspective view of the tank of the heat exchanger of FIG. 6.

In FIG. 7, the structure of tank 3 is illustrated. Tank 3 comprises three plates: a bottom plate 21, a middle plate 23, and an upper plate 22. Along the outer peripheral of bottom plate 21 are a plurality of hooks 38 that may be provided to hold the three plates together during brazing. On bottom plate 21, a plurality of slots 24 and 25 are formed to receive protrusions 27 and 26 of the lower part of heat transfer tubes 2, as shown in FIG. 3. Referring again to FIG. 7, semi-cylindrical parts 35*b* and 35*a*, are formed on bottom plate 21 and middle plate 23, respectively. Semi-cylindrical parts 35*a* and 35*b* form an outlet orifice 35 when joined. Outlet pipe 5 is connected to outlet orifice 35. Semi-cylindrical parts 34*b* and 34*a* are formed on middle plate 23 and upper plate 22, respectively. Semi-cylindrical parts 34*a* and 34*b* form an inlet orifice 34 when combined. Inlet pipe 4 is connected to inlet orifice 34. Inlet orifice 34 is preferably positioned at about the center of tank 3.

Tank 3 is divided into three chambers 31, 32, and 33, by middle plate 23. A plurality of holes 36 of various radii are formed in middle plate 23 and place chambers 31 and 32 in fluid communication. Holes 36 are the mass-flow rate leveling means of this embodiment of the present invention. The radii of holes 36 increases in holes 36 located nearer to inlet orifice 34. Accordingly, the mass-flow rate in the heat transfer tubes farthest from inlet orifice 34 decreases, and conversely, the mass-flow rate in the heat transfer tube nearest inlet orifice 34 increases. Thus, the mass-flow rates in each of the heat transfer tubes are leveled toward a constant value. As a result, all of the heat transfer occurring on the surface of the heat transfer tubes is substantially leveled, and any spacial temperature imbalance over the entire heat exchanger is reduced or eliminated.

Figure 8:
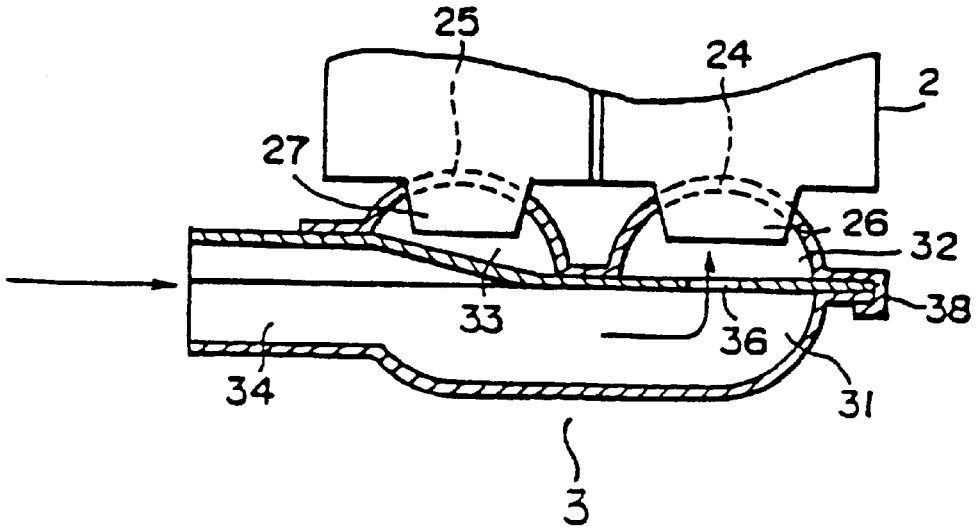
FIG. 8 is a cross-sectional view of the tank along the line VIII–VIII' in FIG. 7.

In FIG. 8, a path of the refrigerant from inlet orifice 34 of tank 3 to heat transfer tubes 2 is shown. The refrigerant passes through inlet orifice 34 and enters first chamber 31. From first chamber 31, the refrigerant passes through the plurality of holes 36, which are the mass-flow rate leveling means, and into protrusion 26, which is an inlet portion of heat transfer tubes 2, via the second chamber 32. The refrigerant enters into heat transfer tubes 2 from protrusion 26, passing through the tubes' U-shaped flow path while exchanging heat with external air, and arrives at protrusion 27, which is an outlet portion of heat transfer tube 2.

Figure 9:
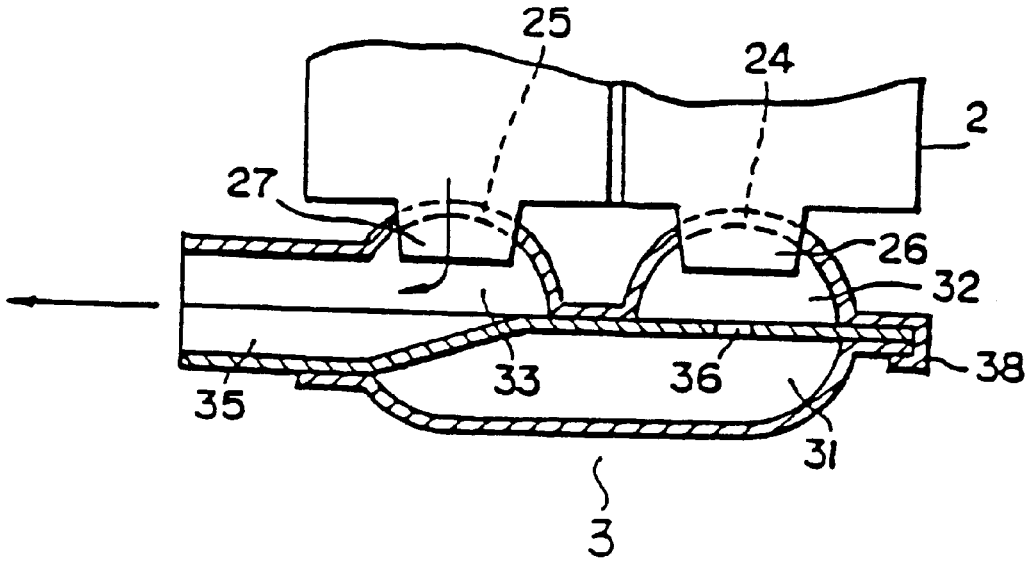
FIG. 9 is a cross-sectional view of the tank along the line IX–IX' in FIG. 7.

In FIG. 9, the path of the refrigerant from protrusion 27 of heat transfer tube 2 to outlet orifice 35 of tank 3 is shown. The refrigerant flowing out of each of the heat transfer tubes 2 via protrusion 27 is collected in a third chamber 33 and then exits third chamber 33 to outlet orifice 35.

Figure 10:
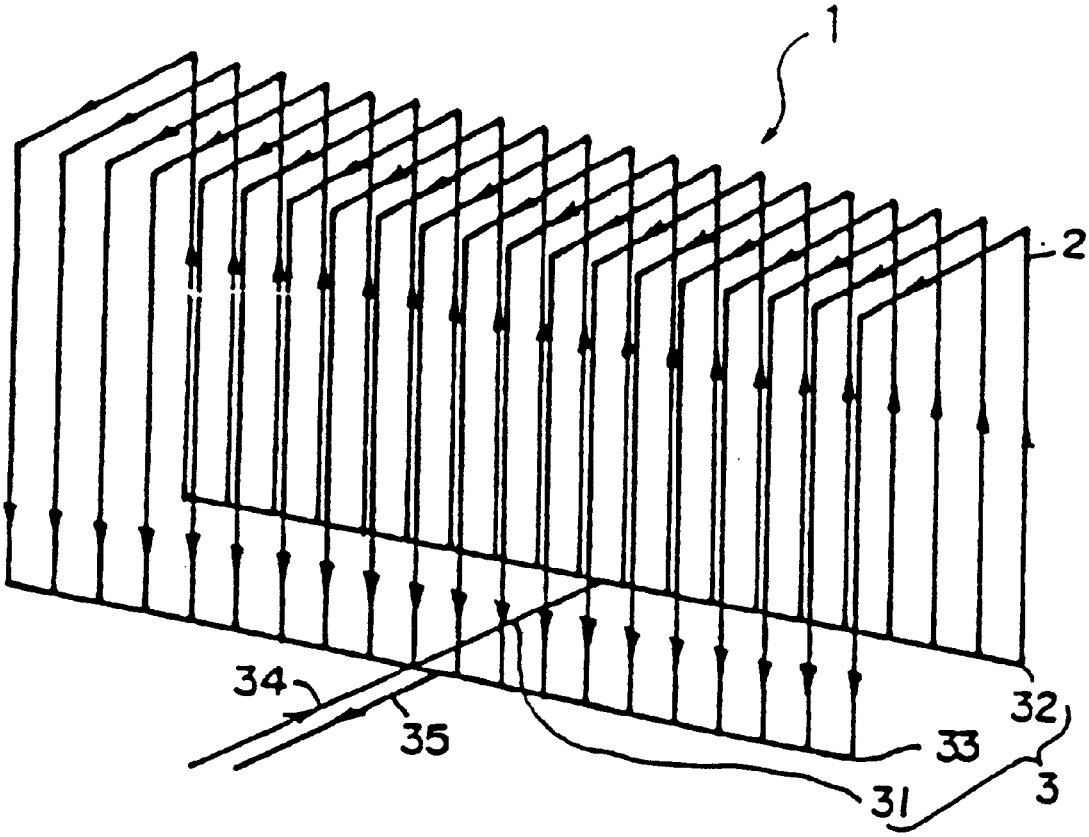
FIG. 10 is a diagram of a fluid flow in the heat exchanger of FIG. 6.

In FIG. 10, the flow of refrigerant within heat exchanger 1 according to the first embodiment of the present invention is schematically depicted.

Figure 11:
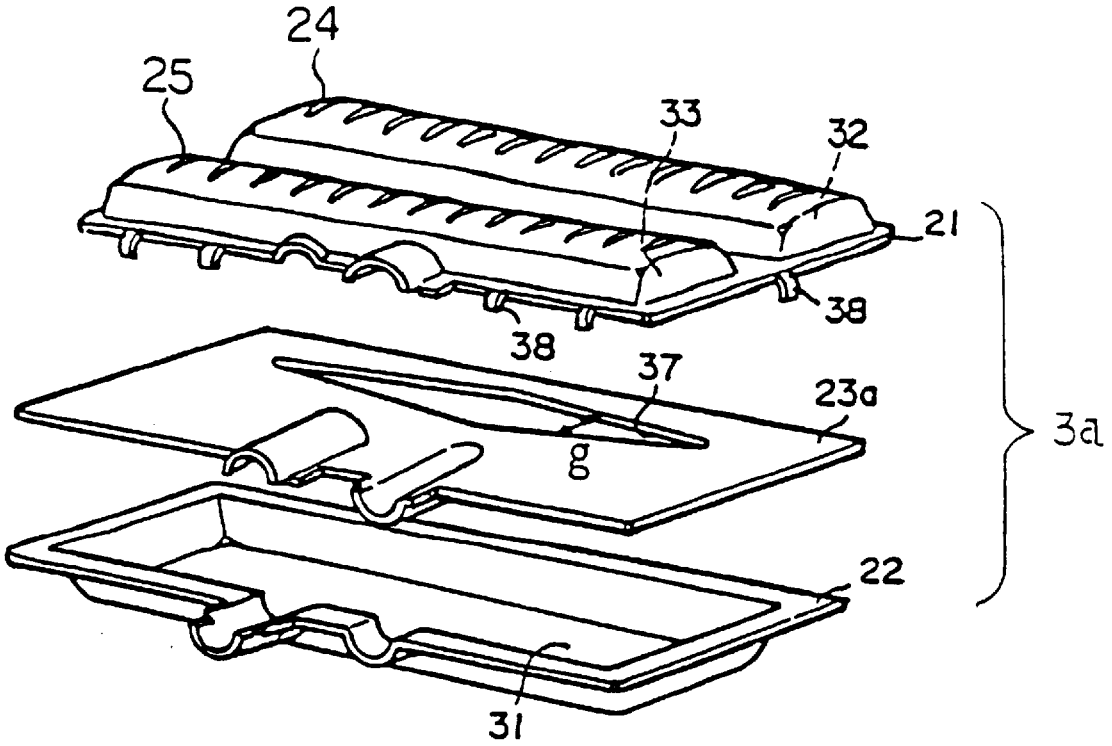
FIG. 11 is an expanded, perspective view of the tank of a heat exchanger according to a second embodiment of the present invention.

With reference to FIG. 11, a second embodiment of the present invention is depicted. The overall structure of the heat exchanger is similar to the heat exchanger depicted in FIG. 6, however, a tank 3*a* is employed. Tank 3*a* comprises a bottom plate 21, a middle plate 23*a*, and an upper plate 22. Bottom plate 21 and upper plate 22 have similar structures to those of tank 3 in the first embodiment. Middle plate 23*a*, however, has a diamond-shaped hole 37 formed therein, that is the mass-flow rate leveling means. As depicted, a gap g becomes shorter as it approaches the vertex of diamond-shaped hole 37. Diamond-shaped hole 37 levels the mass-flow rate of the refrigerant at each position along the length of tank 3*a*. Thus, the mass-flow rates in each of the heat transfer tubes are leveled toward a constant value. As a result, all of the heat transfer done on the surface of the heat transfer tubes is substantially leveled, and any spacial temperature imbalance over the entire heat exchanger is reduced or eliminated.

Figure 12:
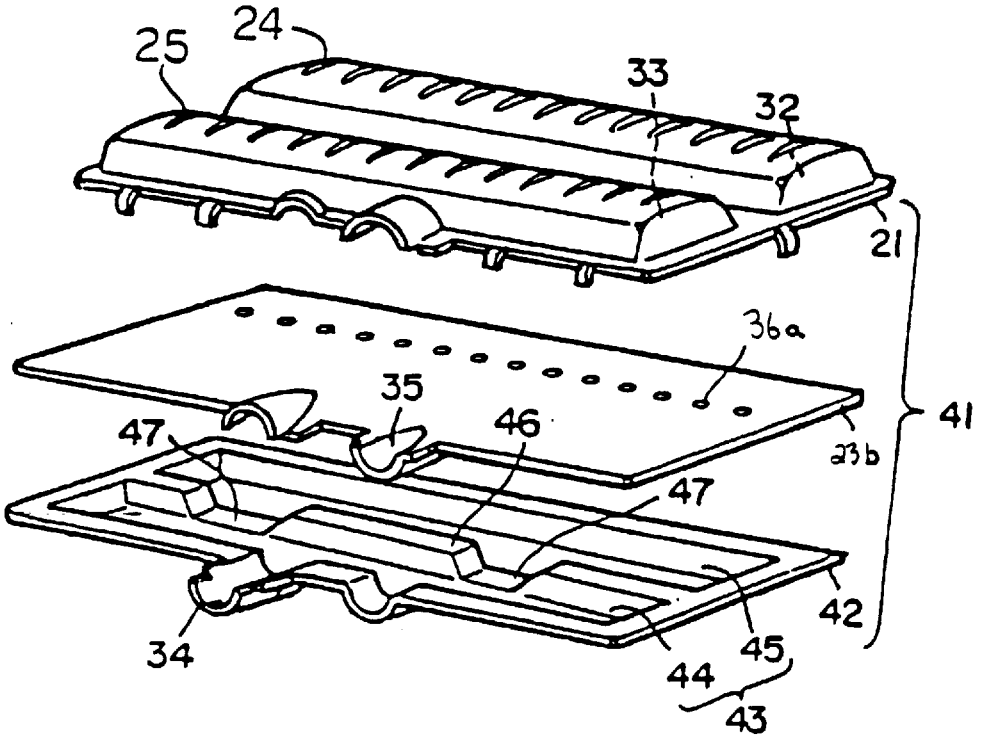
FIG. 12 is an expanded, perspective view of the tank of a heat exchanger according to a third embodiment of the present invention.
Figure 13:
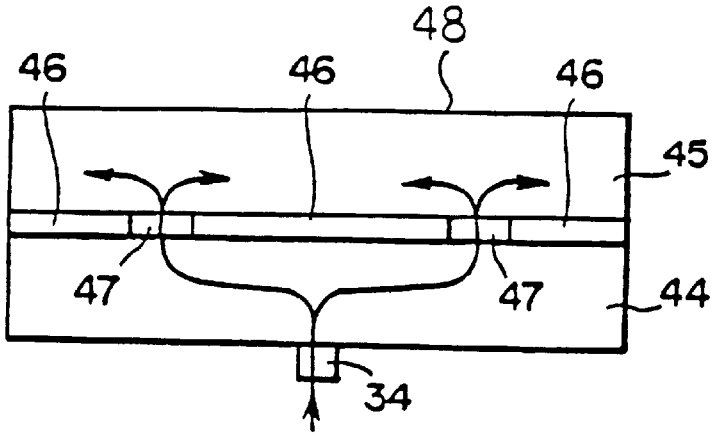
FIG. 13 is a diagram of a fluid flow in the first chamber of the tank of FIG. 12.

With reference to FIGS. 12 and 13, a third embodiment of the present invention is depicted. The overall structure of the heat exchanger is similar to the heat exchanger illustrated in FIG. 6, however, a tank 41 is employed. Tank 41 comprises a bottom plate 21, a middle plate 23*b*, and an upper plate 42. The structures of the bottom plate 21 and middle plate 23*b* are substantially similar to the structures in the first embodiment. Upper plate 42, however, has a wall 46 positioned orthogonal to inlet orifice 34, at about the center of upper plate 42 and in the transverse direction of the tank, and divides a first chamber 43 into two sub-chambers 44 and 45. Sub-chambers 44 and 45 are placed in fluid communication with each other through passageways 47. In FIG. 13, the flow paths of refrigerant within sub-chambers 44 and 45 are shown. The flow of refrigerant that enters sub-chamber 44 through inlet orifice 34, impinges against the central portion of wall 46, and turbulence is thereby created and the flow diverted in two directions. This turbulence tends to prevent the separation of the more liquid component (heavier component) from the more gaseous component (less heavy component) of the refrigerant. The two streams of refrigerant then pass through two passageways 47, enter sub-chamber 45, and impinge against wall 48. Turbulence again is created, and the refrigerant flow is diverted in four directions. This double action of refrigerant turbulence effectively prevents the separation of the heavier and less heavy components.

With reference to FIG. 12, each of holes 36*a* formed in middle plate 23*b* are substantially identical. By the above action, the refrigerant flow rates through each of holes 36*a* from the sub-chamber 45 to second chamber 32 are uniform. From second chamber 32, the refrigerant enters into heat transfer tubes 2 via slots 24, as described above. Thus, the mass-flow rates in each of the heat transfer tubes are leveled toward a constant value. As a result, all of the heat transfer occurring on each surface of the heat transfer tubes is substantially leveled, and any spacial temperature imbalance over the entire heat exchanger is reduced or eliminated.

Figure 14:
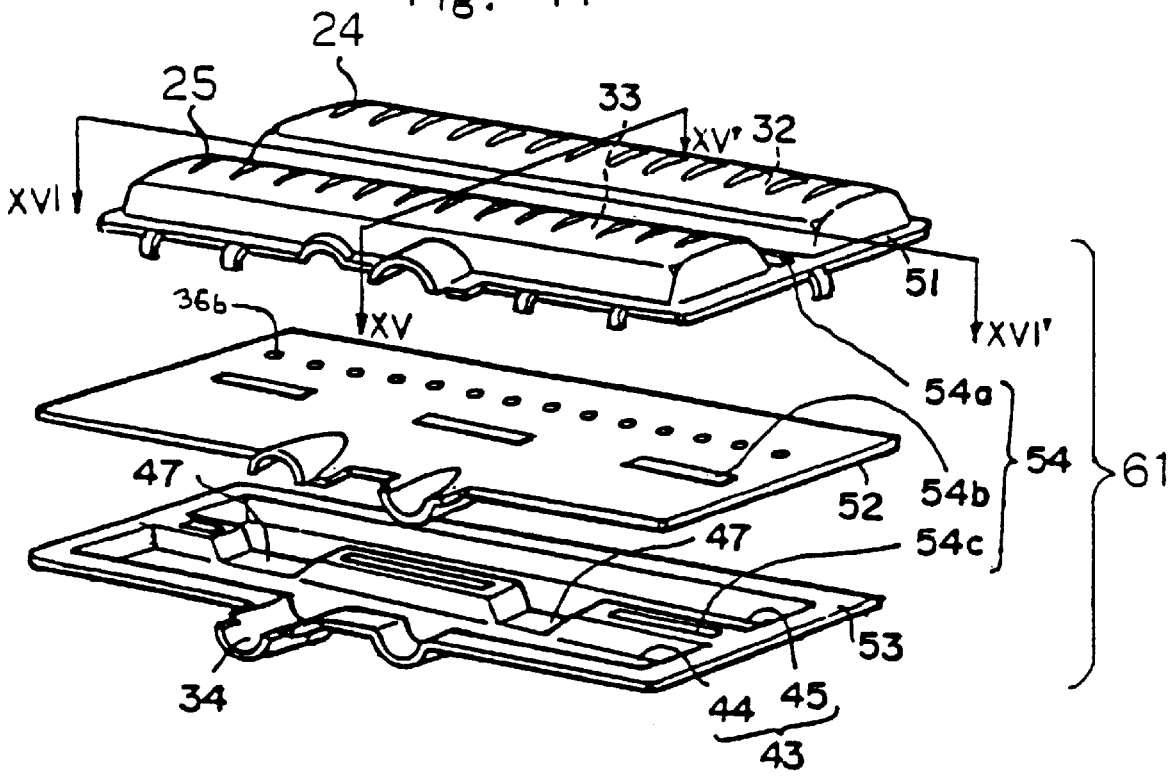
FIG. 14 is an expanded, perspective view of the tank of a heat exchanger according to a fourth embodiment of the present invention.
Figure 15:
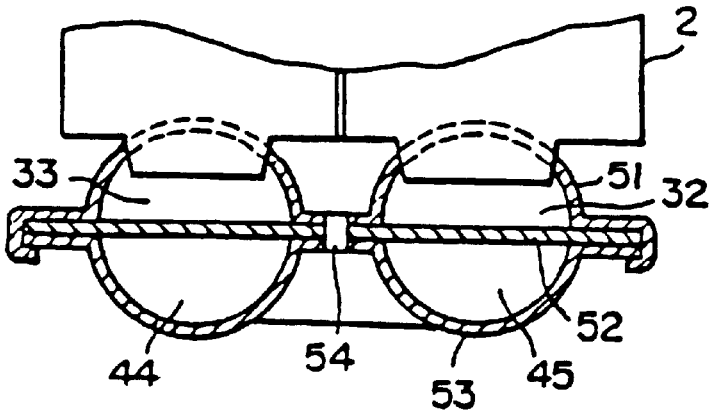
FIG. 15 is a cross-sectional view of the tank along the line XV–XV' in FIG. 14.
Figure 16:
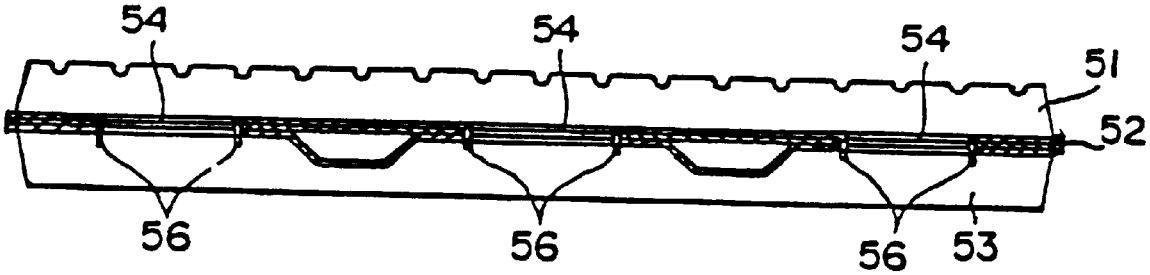
FIG. 16 is a cross-sectional view of the tank along the line XVI–XVI' in FIG. 14.

With reference to FIGS. 14–16, a fourth embodiment of the present invention is depicted. The overall structure of the heat exchanger is similar to the heat exchanger illustrated in FIG. 6, however, a tank 61 is employed. With reference to FIG. 14, the structure and function of the fourth embodiment of the present invention which is similar to the third embodiment, is to level any spacial temperature imbalance. However, in the fourth embodiment, holes 54*a*, 54*b*, and 54*c* (collectively 54) are formed in each of a bottom plate 51, a middle plate 52, and an upper plate 53. Holes 54 drain away water that may condense on the surface of the heat exchanger. In FIG. 15, holes 54 are shown to penetrate the three plates: bottom plate 51, middle plate 52, and upper plate 53. In FIG. 16, a plurality of inner hooks 56 for holding the above three plates together are shown before the hooks 56 are folded over.

Although the present invention has been described in connection with preferred embodiments, the invention is not limited thereto. It will be readily understood by those of ordinary skill in the art that variations and modifications may be made within the scope of this invention as defined by the following claims.

What is claimed is:

1. A two-path flow laminated-type heat exchanger comprising:

a plurality of heat transfer tubes, each forming a U-shaped flow path;

a plurality of fins attached to exterior surfaces of said heat transfer tubes; and a tank comprising three plates and having a first chamber, a second chamber, and a third chamber, said first chamber having an inlet orifice and being in fluid communication with said second chamber via mass-flow rate leveling means, said second chamber being in fluid communication with said heat transfer tubes, and said third chamber being in fluid communication with said heat transfer tubes and having an outlet orifice;

said inlet orifice formed between an intermediate one of said plates and a first outer one of said plates and said outlet orifice formed between said intermediate plate and a second outer plate;

wherein said mass-flow rate leveling means is formed in a plate which separates said first chamber from said second chamber and said third chamber.

2. The two-path flow, laminated-type heat exchanger of claim 1, wherein said mass-flow rate leveling means comprises a plurality of holes formed in said intermediate plate which separates said first chamber from said second chamber and said third chamber, each of said holes having one of a plurality of radii, said radii being approximately inversely proportional to a distance of each of said holes from said inlet orifice.

3. The two-path flow, laminated-type heat exchanger of claim 1, wherein said mass-flow rate leveling means comprises a diamond-shaped hole formed in said intermediate plate which separates said first chamber from said second chamber and said third chamber.

4. The two-path flow, laminated-type heat exchanger of claim 1, wherein:

said mass-flow leveling means are a plurality of circular holes formed in said intermediate plate separating said first chamber from said second chamber, each of said holes having about equal radii;

wherein said first chamber is divided into two sub-chambers by a wall, said sub-chambers being in fluid communication with each other, except at a central portion of said wall, through a plurality of passageways formed in said wall.

5. The heat exchanger of claim 4, wherein a plurality of vertically oriented holes are formed in said tank.

6. The heat exchanger of claim 1, wherein at least one of said three plates includes a plurality of hooks for holding said tank together during brazing.

7. A two-path flow laminated-type heat exchanger comprising:

a plurality of heat transfer tubes, each forming a U-shaped flow path;

a plurality of fins attached to extenor surfaces of said heat transfer tubes; and a tank comprising three plates and having a first chamber, a second chamber, and a third chamber, said first chamber having an inlet orifice and being in fluid communication with said second chamber via mass-flow rate leveling means, said second chamber being in fluid communication with said heat transfer tubes, and said third chamber being in fluid communication with said heat transfer tubes and having an outlet orifice;

said chambers extending along an entire length of said heat exchanger;

wherein said mass-flow rate leveling means is formed in a plate which separates said first chamber from said second chamber and said third chamber.

8. The two-path flow, laminated-type heat exchanger exchanger of claim 7, wherein said mass-flow rate leveling means comprises a plurality of holes formed in said intermediate plate which separates said first chamber from said second chamber and said third chamber, each of said holes having one of a plurality of radii, said radii being approximately inversely proportional to a distance of each of said holes from said inlet orifice.

9. The two-path flow, laminated-type heat exchanger of claim 7, wherein said mass-flow rate leveling means comprises a diamond-shaped hole formed in said intermediate plate which separates said first chamber from said second chamber and said third chamber.

10. The two-path flow, laminated-type heat exchanger of claim 7, wherein said mass-flow leveling means are a plurality of circular holes formed in the intermediate plate separating said first chamber from said second chamber, each of said holes having about equal radii;

wherein said first chamber is divided into two sub-chambers by a wall, said sub-chambers being in fluid communication with each other, except at a central portion of said wall, through a plurality of passageways formed in said wall.

11. The heat exchanger of claim 10, wherein a plurality of vertically oriented holes are formed in said tank.

12. The heat exchanger of claim 7, wherein at least one of said three plates includes a plurality of hooks for holding said tank together during brazing.

* * * * *